US005151010A

United States Patent [19]

Vesala et al.

[11] Patent Number: 5,151,010

[45] Date of Patent: Sep. 29, 1992

[54] COMBINED CENTRIFUGAL AND VACUUM PUMP

[75] Inventors: Reijo Vesala, Kotka; Vesa Vikman, Kymi, both of Finland

[73] Assignee: A.Ahlstrom Corporation, Noormarkku, Finland

[21] Appl. No.: 579,405

[22] Filed: Sep. 7, 1990

[51] Int. Cl.[5] ..... F01D 25/32

[52] U.S. Cl. ..... 415/169.1; 415/143

[58] Field of Search ..... 415/169.1, 143; 55/1, 55/52, 199, 203

[56] References Cited

U.S. PATENT DOCUMENTS 4,776,758 10/1988 Gullichsen ..... 415/169.1

4,877,368 10/1989 Timperi ..... 415/143

*Primary Examiner*—John T. Kwon

*Attorney, Agent, or Firm*—Cohen, Pontani, Lieberman & Pavane

[57] ABSTRACT

A centrifugal pump for pumping gas containing fiber suspensions in the pulp and paper industry includes a centrifugal pumping chamber (54); a centrifugal impeller (60) within the pumping chamber; a liquid ring vacuum pump (70) having a radially vaned vacuum pump rotor (96) therein; an intermediate wall (72) separating the pumping chamber (54) from the vacuum pump (70) which has a non-annular volume (146) therein and which provides a passageway between the centrifugal pumping chamber (54) and the vacuum (70). A conduit (71) within the intermediate wall (72) is connected to the non-annular volume (146) for introducing a liquid into at least one of the non-annular volume and the vacuum pump.

10 Claims, 10 Drawing Sheets

COMBINED CENTRIFUGAL AND VACUUM PUMP

FIELD OF THE INVENTION

The present invention relates to a combined centrifugal/vacuum pump with an intermediate wall separating the centrifugal pump from the vacuum pump and, specifically, to an intermediate wall having a non-annular volume therein.

BACKGROUND AND SUMMARY OF THE INVENTION

Commercial devices which effectively handle gas containing media or suspensions, such as paper pulp, at medium consistency, that is at about 6–15% solids consistency, are known. It is also known that air or, more generally gas, if present in the fiber suspensions causes problems in almost all process stages in the pulp and paper industry. When pulp is pumped, mixed, screened, washed or otherwise handled without excess gas significant savings in equipment, power consumption and the like can be achieved. For instance, one device which has been particularly successful in allowing handling of gas-containing medium consistency fiber suspensions is a fluidizing centrifugal pump which simultaneously pumps and degasses the suspension. Typically, such pumps utilize a separate vacuum pump, piping from the centrifugal pump to the vacuum pump, a separate motor and motor mount for the vacuum pump, etc., in order to exhaust the gas which has been separated from the suspension so that the suspension may be effectively pumped by the pump impeller.

U.S. Pat. No. 3,230,890 discloses a centrifugal pump for removing gas from low consistency suspensions or from water having either a built-in vacuum pump or an external vacuum pump.

A fluidizing centrifugal pump having a built-in vacuum pump is disclosed in U.S. Pat. No. 4,776,758. FIG. 1 illustrates the prior art centrifugal pump, with the volute being omitted, provided with a vacuum pump on the same shaft as impeller. The characteristic features of the prior art pumps on the market today and which have not, however, proven to be successful due to some shortcoming in the structure thereof, are disclosed in detail in the following. The prior art pump of FIG. 1 has a fluidizing impeller 12 rotating in an ordinary medium consistency pump housing. The impeller 12 has through bores 14 for allowing the air accumulated at the front side of the impeller 12 to be drawn by means of the vacuum pump 10 to the back side of the impeller 12. The impeller has also so-called back vanes 16 on the back side thereof for separating the fiber suspension from the medium being drawn through the openings 14 in the impeller plate 18. The main purpose of the back vanes 16 is to pump the fiber suspension back to the pump volute and thus prevent the fibers from entering the vacuum pump 10, as the risk of damaging the vacuum pump 10 rises dramatically if the fibers are allowed to enter the vacuum pump 10. The vacuum pump 10 is a so-called liquid ring pump which has been arranged on the pump shaft 20 behind an intermediate plate 22 in which only a narrow ring-shaped duct 24 is provided which duct surrounds the shaft 20 or the impeller extension 26 for allowing the gas to flow towards the vacuum pump. The intermediate plate 22 is also provided with a ring-shaped channel 28 and a narrow duct 30 leading thereto for introducing make-up air to the vacuum pump while the pump is running. The duct 30 is connected via channel 32 to a vacuum regulating valve (not shown). The vacuum pump housing 34 is provided with a conduit 36 for feeding liquid to the liquid ring pump 10 for maintaining the amount of liquid substantially constant therein. Conduit 36 is connected to the outer, eccentric circumference 38 of the liquid ring pump 10. In other words, the conduit 36 leads exclusively and directly to the liquid ring. The suction opening for the liquid ring pump 10 is provided, naturally, on the side of the centrifugal impeller 12. The discharge channel (not shown) for the gas to be removed from the pump 10 is arranged at the opposite side of the vacuum pump 10, i.e. on the back side of the vacuum pump relative to the centrifugal impeller 12.

Various problems have, however, been encountered with the pump in operation today. For example, the air removal capacity has been significantly lower than required, i.e. the vacuum created has not reached a sufficiently high level. Also, the discharge pressure of the vacuum pump has been found to be too low. In some cases, it is desired to introduce the material discharged from the vacuum pump, a mixture containing mainly gas but also some fibers, into the top portion of a mass tower to recover the fibers. If, however, the discharge pressure of the vacuum pump is too low the pumped material cannot be conveyed to the top of the mass tower, and an additional pump must be installed for that purpose. Most importantly, the open annular volume in the intermediate plate 22 of prior art pump has a tendency to become clogged by the fibers.

In the prior art pump the axial gap 40 between the vanes 42 of the vacuum pump 10 and the axially adjacent walls 44 of the vacuum pump housing are not adjustable but are positioned with a distance or clearance of about 0.4 mm. The reasons for such relatively large clearance is the fact that there are a number of factors which render it is impossible to further decrease the clearance 40 as the various components of the pump are installed on the shaft or around the shaft starting from the drive end 46 of the shaft. Thus, the dimensions of the components effect the clearance 40. The result of too wide a clearance is, of course, an insufficient vacuum. Another reason for the wide clearance 40 may also be the fact that the shaft 20 of the pump tends to flex somewhat during operation creating the risk of mechanical contact between the vacuum pump vanes and the housing walls 44. Thus, the large clearance 40 has been provided intentionally to ensure long lasting operation of the pump.

The pump in accordance with the present invention is designed to eliminate most or all of the above problems. Accordingly the pump of the present invention is provided with an intermediate plate separating the centrifugal pump from the vacuum pump which is, preferably, a liquid-ring pump. A non-annular volume is provided within this intermediate plate which non-annular volume communicates with the inside of the vacuum pump chamber and the outside of the pump for permitting gas as well as liquid to flow through the non-annular volume into the vacuum pump chamber. The non-annular opening provided in the intermediate plate is located at or in close proximity to the shaft in accordance with the pressure distribution present in the volute. For example, if located at the point of highest pressure, less vacuum or no additional vacuum is required to discharge the gas from the volute. Alternatively, the non-annular opening may be located at the point of lowest pressure just behind the pump outlet when viewed in the direction of rotation of the pump impeller thereby preventing the fibers from being drawn into the volute together with the gas.

In addition, the non-annular opening is preferably connected to a non-annular volume in the intermediate plate.

In a further embodiment of a pump and in accordance with the present invention an open annular volume is arranged within the back vanes of the centrifugal impeller by providing an annular surface substantially parallel to the shaft or the impeller extension sleeve either at the back plate of the impeller or at the radially inner edges of the back vanes so that a circular space or gas flow passage is formed between one side of said annular surface and the intermediate wall or between one side of the surface and the impeller back plate depending on where the annular surface is attached. The open circular gas flow passage is useful for equalizing the pressure differences in the space between the back vanes of the centrifugal impeller.

The pump of the present invention may also be provided with means for introducing a liquid into the pump, and especially into the non-annular volume and air flow ducts of the pump for flushing these critical locations with a liquid such as flushing water and freeing the pump from fibers which otherwise tend to block the flow path of the pump. The flushing ducts may also be used to supply working liquid to the liquid ring of the vacuum pump.

The pump of the present invention also provides means for adjusting the relative axial position of the vacuum pump rotor relative to the front and rear wall of the vacuum pump chamber thereby providing significantly smaller operational clearances therebetween. This may be achieved by either adjusting the axial position of the rotor with respect to the shaft, for example, by the addition of shims between respective shoulders of the vacuum pump rotor and shaft. The relative axial position of the vacuum pump rotor with respect to the vacuum pump chamber may also be optimized by adjusting the axial position of the shaft with respect to the vacuum pump chamber and the centrifugal pump body, in which case the vacuum pump rotor is fixedly attached to the shaft. Finally, the relative axial position of the vacuum pump rotor and the vacuum pump chamber is optimized by adjusting the vacuum pump chamber with respect to the rotor and the centrifugal pump body, for example, by adjustment screws as is further described in detail below.

In addition, ports for the admission of make-up air for the control of the vacuum pump may be provided at the rear wall of the vacuum pump. By rear wall of the vacuum pump is meant that wall which is located opposite the air inlet port and distal the centrifugal pump housing.

Axial clearances between the vacuum pump rotor and the vacuum pump chamber walls may also be adjusted by providing a rotor with rotor blades which are slightly tapered in radial direction or wherein the side walls of the vacuum chamber are slightly tapered in radial direction relative to the shaft to account for the slight bending or flexing of the shaft during operation of the vacuum pump.

The vacuum pump may also be designed so that the air inlet port and the outlet port are on the same site of the pump within the intermediate plate and the rotor central portion is tapered conically toward the gas outlet of the pump so as to prevent the formation of a gas pocket around the rotor central portion.

The pump of the present invention is also provided with means for introducing a sealing liquid to the clearances between the vacuum pump rotor and adjacent side walls for sealing the same and thus increasing the pumping action of the device. The sealing liquid may be introduced separately to one or both sides of the vacuum pump chamber so that it can flow into and seal the space or clearance between the pump rotor and adjacent side walls of the vacuum pump. The sealing liquid may also be fed to the spaces through a single conduit leading through the central portion of the vacuum pump rotor. A control valve for regulating the vacuum of the vacuum pump may also be directly attached at the end of the make-up air channel.

DETAILED DESCRIPTION OF THE PRESENTLY PREFERRED EMBODIMENTS

Figure 1:
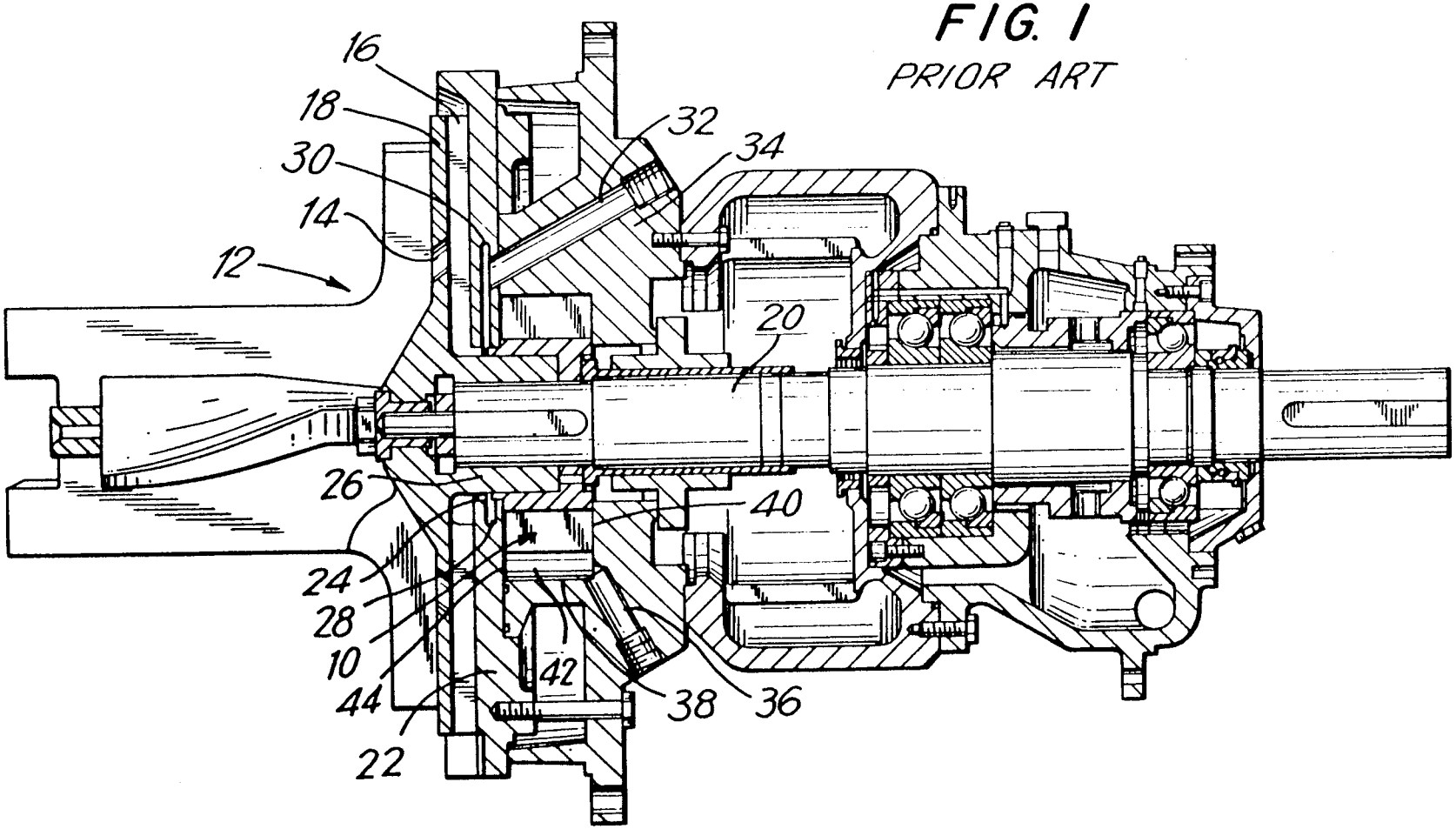
FIG. 1 PRIOR ART
FIG. 1 is a vertical cross-sectional view of an exemplary prior art pump with the conventional pump housing not shown.
Figure 2:
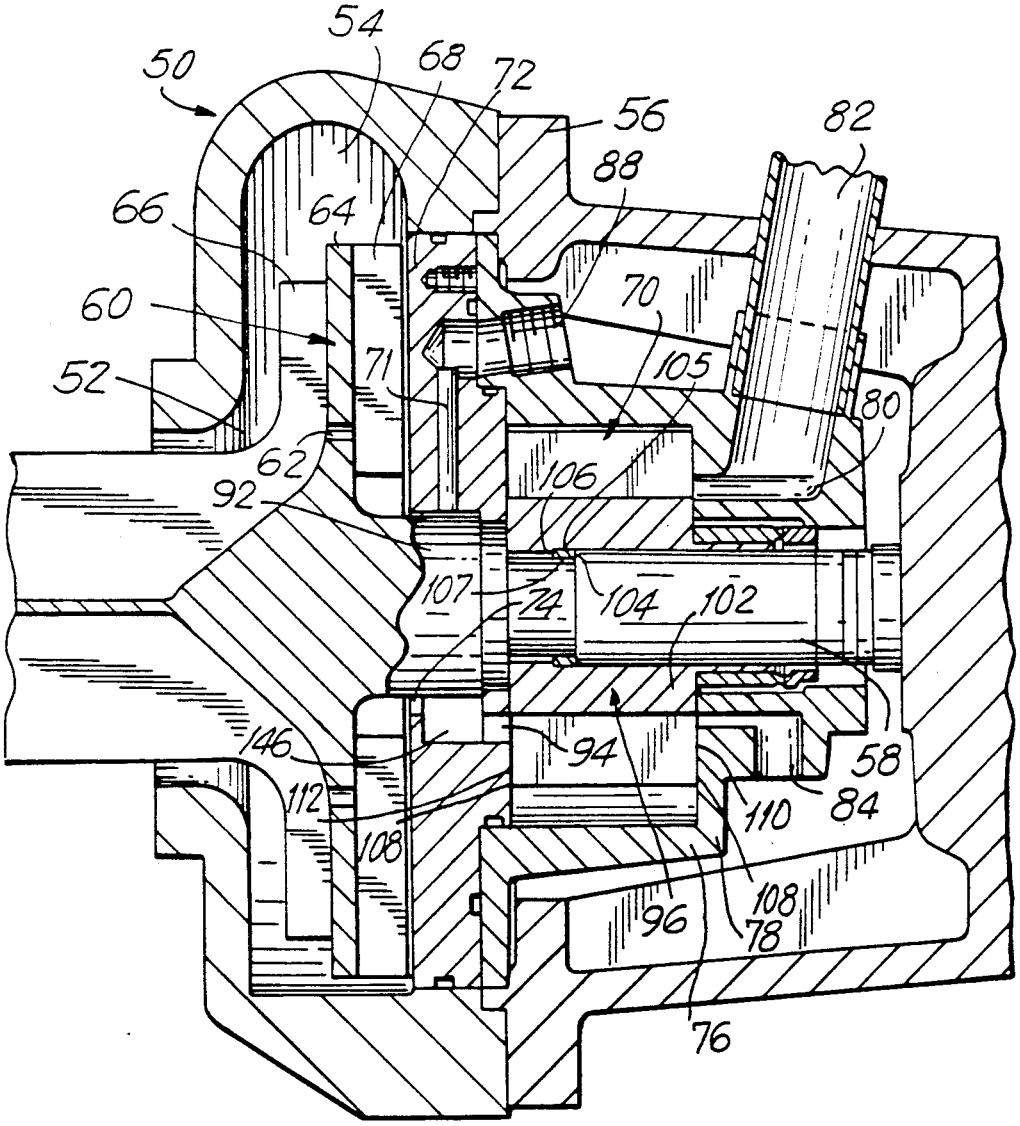
FIG. 2 is a partial vertical cross-sectional view of a centrifugal pump showing the non-circular volume in accordance with the present invention.

FIG. 2 shows a vertical cross-sectional view of the centrifugal pump in accordance with the present invention. The centrifugal pump includes a housing 50 including an inlet channel 52 and a volute 54. The housing 50 is attached to the pump frame 56 having at one end thereof the bearing assembly (not shown) for supporting the pump shaft 58 at the end of which the centrifugal impeller 60 having a plurality of openings 62 in its back plate 64 is mounted. The centrifugal impeller 60 is further provided with front vanes, i.e. working vanes 66, on the front side thereof and with back vanes 68 on the opposite side of the back plate 64. A rotor having fluidizing blades 61 thereon may be mounted on the shaft 58 in front of impeller 60 for pumping fiber suspensions of medium or high consistency. The fluidizing blades may extend through the pump inlet 52 or be located only outside the inlet and within the pulp containing vessel. Located between the bearing unit and the centrifugal impeller 60 is the sealing assembly (not shown). Between the sealing assembly and the centrifugal impeller 60 there is mounted a vacuum pump 70 on the same shaft 58 as the centrifugal impeller 60. The vacuum pump 70 is separated from the volute 54, i.e. from the space housing the centrifugal impeller 60, by means of an intermediate plate 72 which also forms the head or the front wall 112 of the vacuum pump 70. In this embodiment, plate 72 has a non-annular opening 74 in the vicinity of the shaft 58 for permitting the gas to flow from the space behind the centrifugal impeller 60 to the vacuum pump 70. Non-annular opening 74 preferably extends proximate shaft 58 or, depending on the design, proximate impeller extension sleeve 92, and communicates with the vacuum pump 70 through preferably non-annular volume 146 and gas inlet port 94. As explained elsewhere in detail herein, an entry port 88 and narrow conduit 71 is provided within the vacuum pump housing for introducing a liquid, such as water, to the vacuum pump 70 to be used as a working liquid therein, i.e. to be used as the liquid ring which is continuously exhausted through outlet 80 together with the air. On the other hand, a liquid, such as a water, may also be introduced into liquid inlet port 88, and through narrow conduit 71 into non-annular opening 74, non-annular volume 146 and gas inlet port 94 to remove fibers therefrom which have entered these areas and may otherwise clog these passages and prevent the air from passing therethrough. The advantage of combining a relatively narrow inlet duct 71 with non-annular volume 146 lies in the fact that flushing water or sealing liquid can be introduced through narrow duct 71 into the non-annular volume and from there into the vacuum pump. On the other hand, fibers which may be present in the non-annular volume are prevented from passing into the duct 71 as there is only a very small and narrow connection between duct 71 and non-annular volume 146. This connection or narrow clearance around shaft 58 is in the nature of a seal which is filled with liquid from duct 71 and thus maintained free from fibers.

Non-annular opening 74 may be arranged as needed at locations of different pressure along the pump volute. As is known, for example, the point of lowest pressure in the volute occurs just behind the pump outlet when viewed in the direction of rotation of the pump impeller. Locating the non-annular opening 74 at this position substantially decreases the danger of the fibers being drawn into the opening together with the gas. The opening 74 may also be located at the point of highest pressure thereby requiring less vacuum for the removal of gas or the opening 74 may be positioned at any other location between the highest and the lowest pressure as desired. For ease of manufacture non-annular opening 74 may be first shaped as a circular groove whereby the actual connection with non-annular volume 146 is, of course, necessarily also non-annular.

Figure 3:
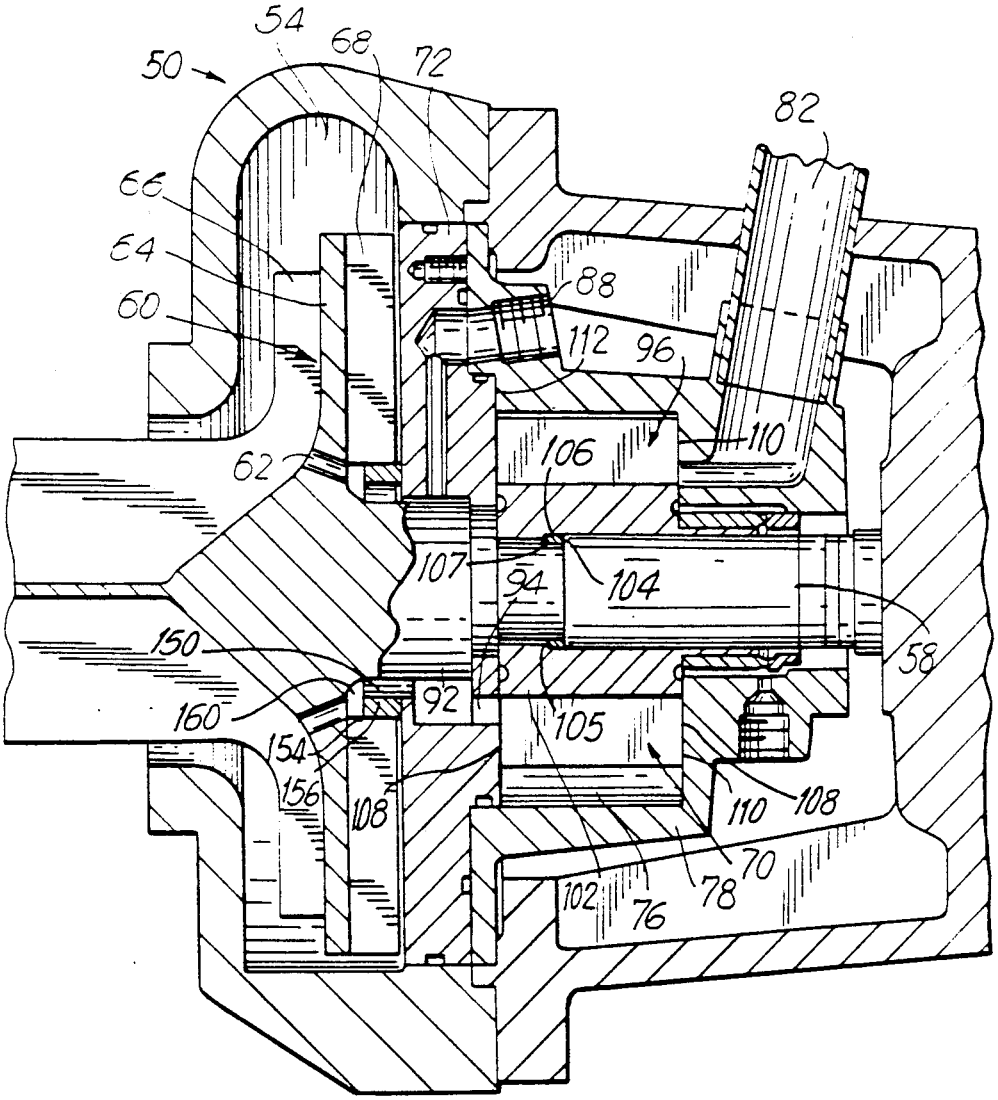
FIG. 3 is a partial cross-sectional view of a further embodiment of the present invention.

FIG. 3 shows an open L-shaped annular volume 150/160 which is arranged in connection with the centrifugal impeller 60 as follows. The impeller 60 has an impeller backplate 64 and attached thereto and extending toward the back wall of the pump are impeller back vanes 68. Back vanes 68 have edges 154 which extend substantially parallel to the impeller extension sleeve 92 or the shaft 58 between the impeller backplate and in close proximity to intermediate plate 72 which forms the back wall of the centrifugal pump and the head or front wall of the vacuum pump 70. A ring 156 is attached to and extends substantially parallel along the edges 154 of back vanes 68 thereby providing a gas flow passage 160 between the impeller back plate 64 and the annular ring 156. As, in this embodiment, the ring is attached only to the inner axial edges 154 of back vanes 68, it will rotate with the impeller during the operation of the pump. Alternatively, the ring 156 may also be attached only to the back wall 72 or to the impeller back plate 64 thereby forming a flow passage between the ring and the impeller back plate or between the ring and the intermediate wall 72. Open annular volume 150/160 is advantageous for equalizing the pressure differences which exists between the back vanes of the centrifugal impeller. A suitable open annular flow passage between the inner edge of the back vanes and the hub portion or shaft is, of course, also formed without ring 156. Thus, the described ring 156 is not necessary in all applications. For example, a suitable gas flow passage can be provided as a circular groove in the intermediate wall opposite the back vanes and which surround the impeller and which is connected to the opening 74 and volume 146 to allow gas to flow between the respective spaces formed between the back vanes so that it is not necessary to shorten the back vanes as described.

Alternatively a gas flow passage can be formed by removing only a small portion of each back vane close to the hub portion or shaft so that there is a free flow of gas between respective spaces between the back vanes.

Referring again to FIG. 2, the vacuum pump chamber 76 is arranged within the vacuum pump housing 78. The vacuum pump 70 is a so-called liquid ring pump with an eccentric chamber 76 relative to the rotor 96. The vacuum pump housing 78 has, in addition to the eccentric chamber 76, a discharge port or pipe 80 for the gas at the pressure side of the chamber 76 (the upper side in FIG. 2) and leading to a gas discharge connection 82 on the outer surface of said housing. As shown in FIG. 2, the housing 78 further has an additional air duct 84 leading to the eccentric chamber 76 at its suction side (the lower side in the drawing) and through the back wall 110 of the vacuum pump chamber relative to its front wall 112 or opposite the head or intermediate plate 72. Duct 84 is for providing control or make-up air to the vacuum pump 70, i.e. for controlling the vacuum of the pump and for maintaining the vacuum at a constant level. It is to be noted that air duct 84 is dimensioned with respect to its diameter and length so that the vacuum pump 70 will readily receive additional air in case there is insufficient air flowing from the material to be pumped. A control valve (not shown) for regulating the vacuum of the vacuum pump may be directly attached to the end of the make-up air duct 84.

In accordance with one embodiment of the present invention (FIG. 4A) intermediate plate 72 is provided with a relatively wide duct 86 for the introduction of a liquid such as flushing water or the like leading from the connection 88 on the vacuum pump housing or body 78 outer surface to the non-annular opening 74 and volume 146 within the plate 72. As stated, duct 86 is also used for introducing a liquid such as water to the vacuum pump 70, for instance for feeding liquid to the liquid ring or for flushing either the vacuum pump 70, the non-annular opening 74, volume 146 and/or the inlet channel 94 to the vacuum pump 70 in case there are solids in these locations which must be removed to prevent the clogging thereof.

The vacuum pump 70 has a rotor 96 with outwardly extending vanes 98 for keeping the liquid ring rotating along the eccentric surface 100 of its chamber 76 (FIGS. 2 and 3). The rotor 96 has a cylindrical central portion 102 arranged to lie between a shoulder 104 of the shaft 58 and the centrifugal impeller hub or extension sleeve 92 so that the axial location of the vacuum pump rotor 96 with respect to the centrifugal impeller 60 is fixed. Between the shoulder 104 of the shaft and the shoulder 105 of rotor 96 is a free space 107 into which spacer means may be introduced, for example, by arranging one or more preferably annular shims 106 of predetermined width between the respective shoulders 104, 105 to optimize the axial clearance 108 between the rotor vanes 98 and the side walls 110 and 112 of the vacuum pump chamber.

Accordingly, the provision of shims 106 between the shoulder 104 of shaft 58 and the shoulder 105 of the vacuum pump rotor 96 enables the precise adjusting of the clearance or distance 108 after manufacture of the components of the pump and during the assembly thereof. This way, all of the above discussed factors which may affect the axial play and location of the centrifugal impeller 60 and the vacuum pump rotor 96 are eliminated. It is thus possible to minimize the clearance or distance 108 between the vanes 98 and the vacuum pump chamber walls 110, 112. Preferably, the clearance 108 is as small as about 0.20 mm and in any case less than 0.30 mm and preferably less than about 0.25 mm.

As stated, the shoulder 105 on the vacuum pump rotor 96 and the shoulder 104 on the shaft 58 are designed so that there is a gap 107 left therebetween. Upon assembly, the actual desired gap between the shoulders 104 and 105 is determined and one or more shims with corresponding axial dimension are chosen so that the clearance 108 on both sides of the rotor with respect to the vacuum pump side walls correspond to the predetermined value. Thus, the possibility of adjusting the clearance upon assembly of the pump eliminates the need of over-dimensioning the pump chamber in order to provide safety clearances.

The pump shaft is mounted in axially fixed position with respect to the pump body. If the location of the shaft is altered, for example, due to the replacement of the bearings, the shims 106 can be changed and replaced with shims having smaller or wider axial width so that the position of the vacuum pump rotor is again optimized.

Figure 4A:
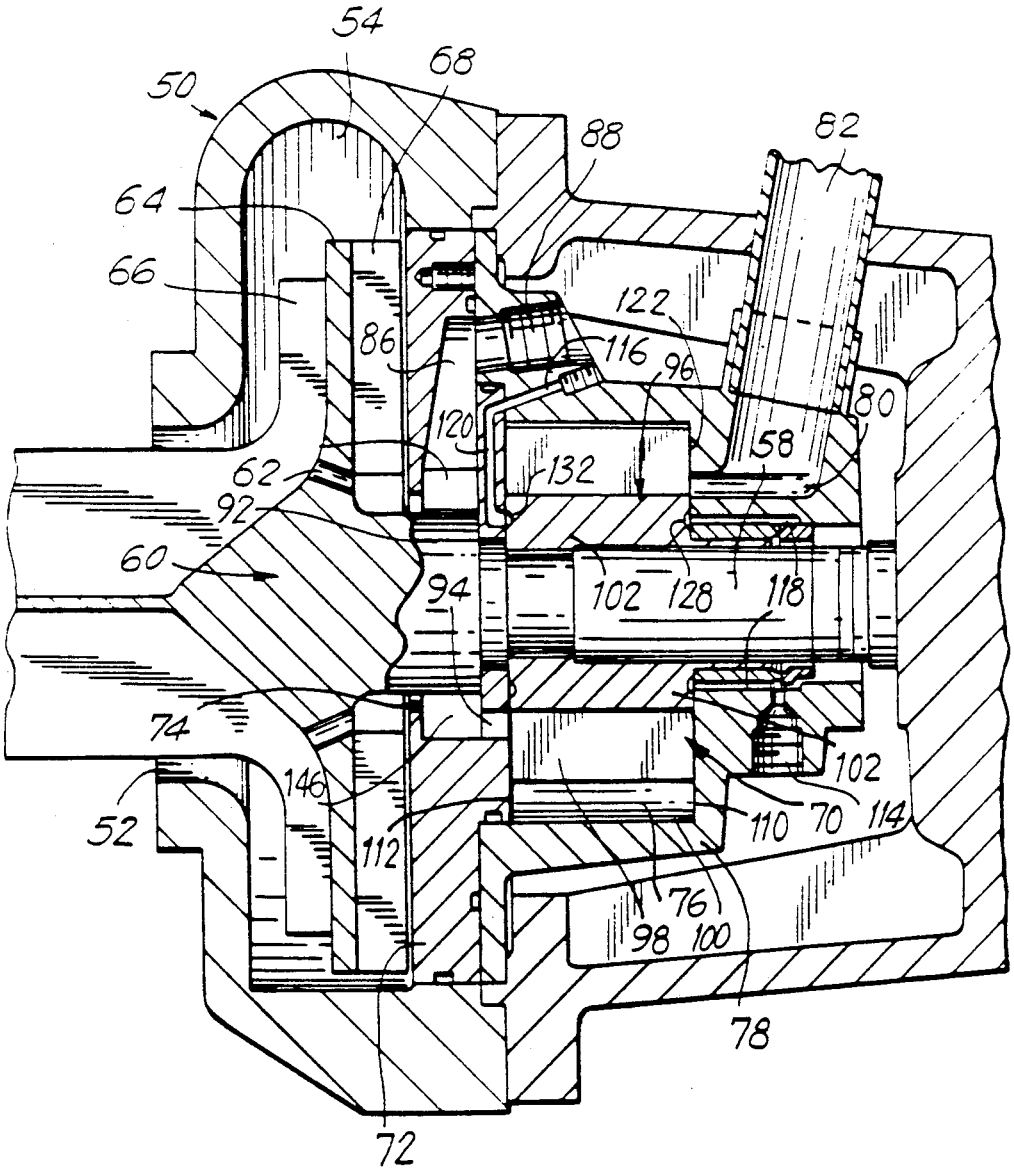
FIG. 4A is a partial cross-sectional view of a further embodiment of the pump of the present invention.

In accordance with one embodiment of the present invention, FIG. 4A shows the vacuum pump housing 78 provided with two connections or ports 114, 116 located on opposite sides of the vacuum pump chamber 76 for introducing sealing liquid via ducts 118, 120 to both sides of the vacuum pump rotor 96 for sealing the clearance 122 between the vacuum pump rotor 96 including central portion and vanes and side walls 110, 112 of the eccentric vacuum pump chamber 76. Preferably, the sealing liquid, such as water, is fed at or around central portion 102 of vacuum pump rotor 96 so as to begin sealing the portion closest to shaft 58. The sealing liquid is thereafter carried outwardly by centrifugal forces during the operation of the vacuum pump. By feeding sealing liquid to the inner portion of the vacuum pump chamber 76, the pressure in the pump is prevented from escaping from the spaces between the vacuum pump vanes 89 resulting in the vacuum and also in the discharge pressure in the outlet 82 being significantly higher. As stated, in the embodiment shown in FIG. 4A, a first sealing liquid inlet port 114, is provided at the back side of the vacuum pump (in FIG. 4A the right hand side of the pump). Conduit 118 which extends substantially parallel to shaft 58 connects the vacuum pump chamber with liquid inlet port 114. Preferably, the sealing liquid inlet into the vacuum pump chamber 76 through either one or both of the side walls of the vacuum pump is located in close proximity to the pump shaft 58 so that the sealing liquid will be supplied to the clearance 122 in the region of the central rotor portion 102 and the side wall 110, 112 of the vacuum pump housing 78.

To supply the clearance at the side between the pump rotor 96 and intermediate wall 72, 112 with sealing liquid an additional sealing liquid inlet port and conduit 116 is provided to extend through the vacuum pump housing 78 and intermediate wall 72. The sealing liquid is again supplied through conduit 116 directly to the front side of the vacuum pump and through a further channel (not shown) surrounding shaft 58 and which is preferably, but not necessarily circular, to the lower or suction side of the vacuum pump. This way, sealing liquid, such as water is supplied to both sides of the vacuum pump rotor thereby markedly increasing the pumping action thereof. It is to be noted that the sealing liquid will also seal the entire clearance between the radial length of the vanes 98 of the vacuum pump rotor and the side walls 110 and 112 of the vacuum chamber 76 as the centrifugal force acting on the sealing liquid together with the feed pressure will force the sealing liquid to flow along the vanes 98 in an outward direction.

It should be noted that in accordance with the invention wide flush water duct 86 and liquid inlet conduit 116 in FIG. 4A can be replaced by only one narrow conduit 71 and a non-annular volume 146 as hereinbefore described. (FIGS. 2 and 3).

Figure 4B:
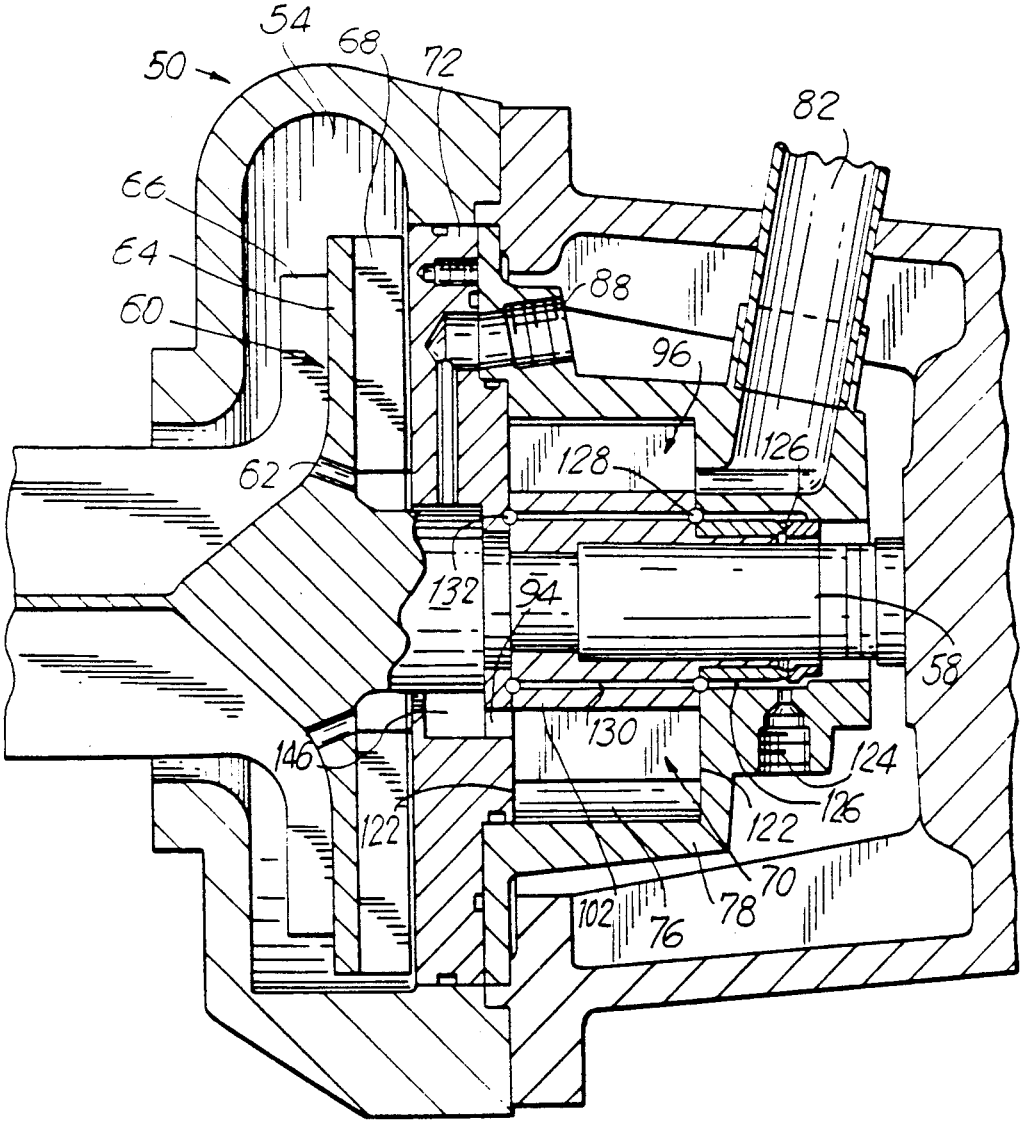
FIG. 4B is a partial cross-sectional view of yet another embodiment of the pump of the present invention.

In the embodiment shown in FIG. 4B, the sealing liquid is fed to both sides of the vacuum pump by using only one inlet port 124. The inlet port 124 is located in the vacuum pump housing adjacent the right hand side of the eccentric vacuum pump chamber 76. It is understood that the mentioned eccentricity is caused by the rotor being mounted at a position eccentric relative to the pump chamber as is necessary in liquid-ring pumps of the type described herein.

Sealing liquid inlet port 124 is connected to conduit or duct 126 which guides the sealing liquid into the clearance 122 between the vacuum pump rotor 96 and the vacuum pump side wall 110. Conduit 126 leads from inlet port 124 to a circular groove 128 within the vacuum pump rotor central portion 102 and through at least one throughbore 130 in said central portion 102 to preferably a second groove 132 at the opposite end of the vacuum pump rotor central portion 102. This way only one port 124 for the introduction of sealing liquid is required. It is understood that grooves 128 and optional groove 132 can also be located only in the vacuum pump chamber in the walls or may be provided in both the side walls and the rotor central portion as shown.

It is to be noted that mechanical sealing means may also be used such as, for example, gliding sealings or labyrinth seals.

It is understood that a circular groove may also be provided in the embodiment described in FIG. 4A at the locations at which the sealing liquid enters the vacuum chamber at either one or both the vacuum chamber side walls and/or the rotor central portion 102

Figure 5:
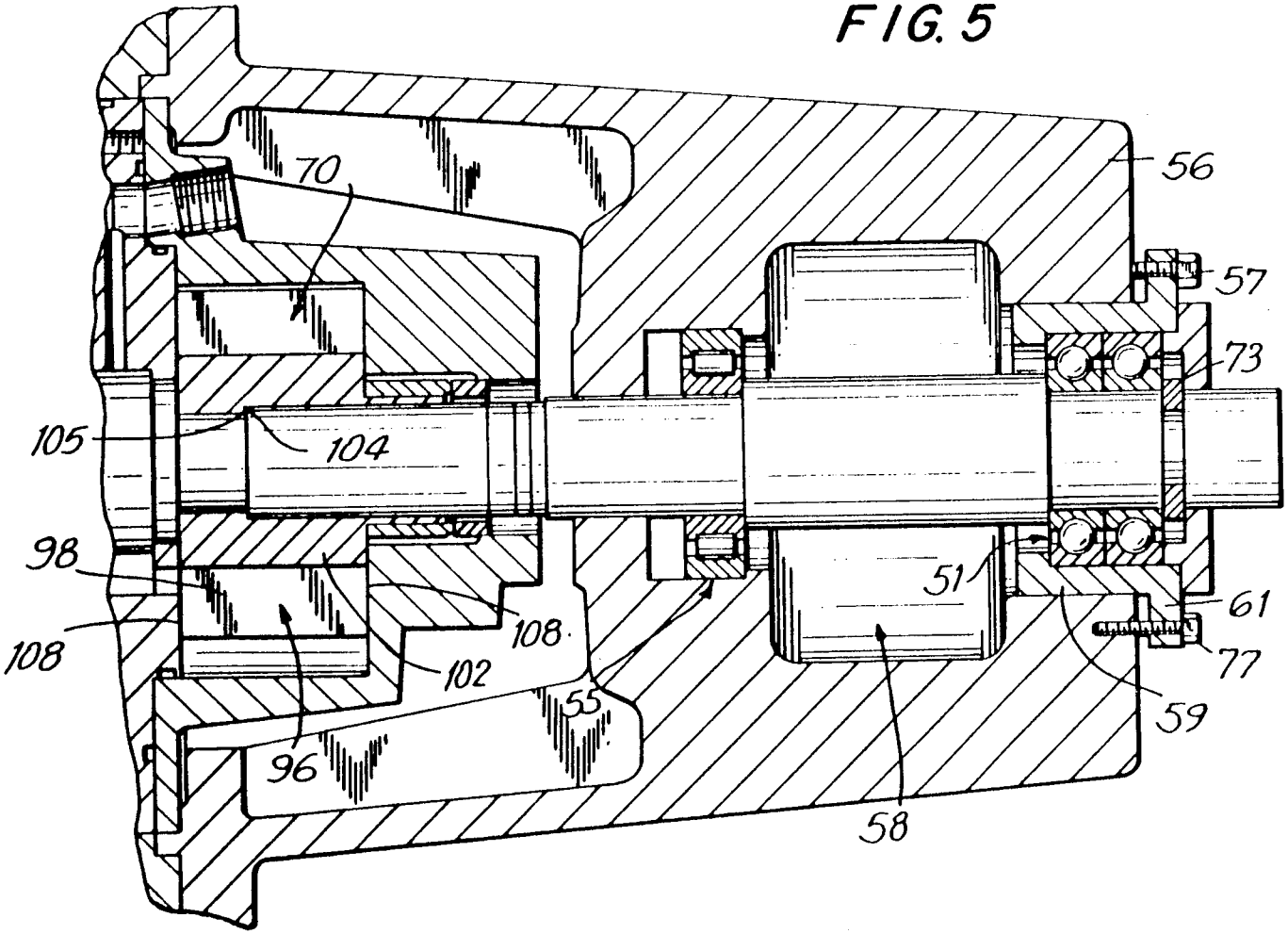
FIG. 5 is a partial vertical cross-sectional view illustrating another embodiment of the present invention.

As shown in FIG. 5, shaft 58 is mounted within pump frame 56 by suitable bearing units 51 and 55. The bearing unit 55 is slidably mounted and the bearing unit 51 is secured with a suitable locking means such as a lock unit 73 so that it will not slide along the shaft. The remainder of the pump is essentially the same as that described in connection with FIG. 2, above. However, in this embodiment, vacuum pump rotor 96 with its central portion 102 and pump vanes 98 is fixedly secured to shaft 58 with the shoulder 105 of rotor 96 engaging a correspondingly shaped shoulder 104 of shaft 58. Instead of adjusting clearances 108 with shims 106 as in FIGS. 2 and 3 above, in this embodiment, the axial position of the shaft can be adjusted by bolts 57 as follows. Bearing unit 51 is secured to slidable bearing support member 59 by, for example, a tongue and groove arrangement (not shown) or any other suitable manner. Support member 59 has a bracket 61 which is provided with a threaded opening for receiving one or more adjusting bolts 57. Turning of bolts 57 will cause the shaft to move in a backward direction. Shaft 58 is kept in fixed position within bearing unit 51 and locking means 73. Adjusting and fixing bolt 77 extends through an opening in bracket 61 into threaded engagement with frame 56. Turning of adjusting bolts 57 and 77 permits the axial adjustment of shaft 58 in both directions and thus the precise positioning of the vacuum pump rotor 96 within vacuum pump chamber 76 allowing minimal clearances 108 between the rotor and the vacuum pump side walls.

Figure 6:
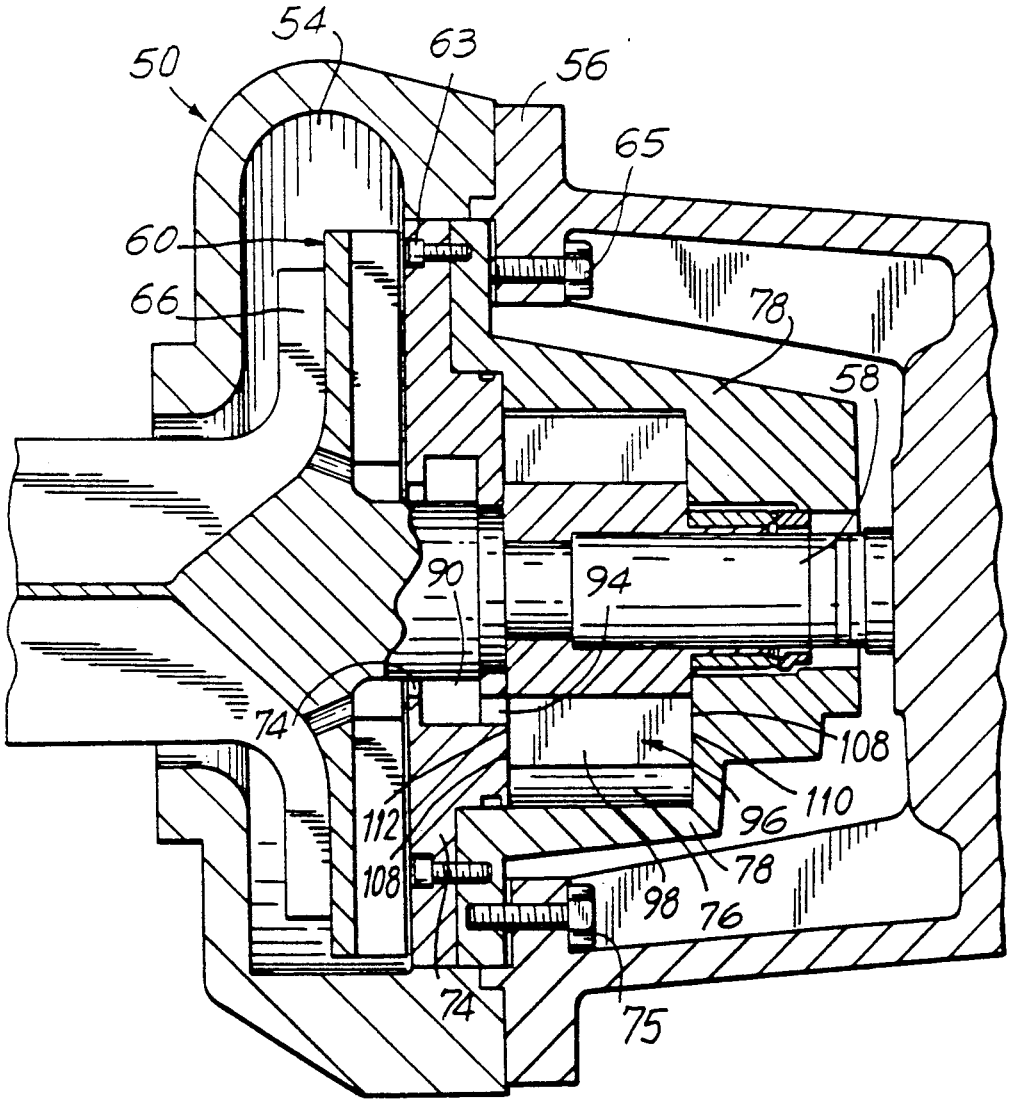
FIG. 6 is a partial cross-sectional view of a further embodiment of the present invention.

FIG. 6 shows a partial cross-sectional view of the centrifugal pump housing 50 and intermediate wall 72 separating the centrifugal pump chamber from the vacuum pump chamber 76. The intermediate wall 72 also frequently called "air head" or simply "head" has a central portion with an open volume 90 therein which is in communication with the vacuum pump chamber 76 and volute 54 through suitable openings 74 and 94. The vacuum pump housing 78 is fastened to intermediate wall or head 72 by bolts 63. One or more bolts 65 threadedly engage in pump frame 56 and one or more bolts 75 threadedly engage vacuum pump housing 78. Thus, the vacuum pump housing 78 and the fixedly secured head 72 are retained in place relative to the frame 76 by the one or more adjusting bolts 65 and 75 which permit the movement of the vacuum pump housing together with head 72 in axial direction relative to the shaft 58 so that the vacuum pump rotor 96 can be arranged within the vacuum pump chamber with minimal clearances 108 between the vacuum pump rotor 96 and its vanes 98 and the vacuum pump side walls 110 and 112. The rotor 96 is fixed on shaft 58 with mutually engaging shoulders 104, 105 as described above.

Figure 7:
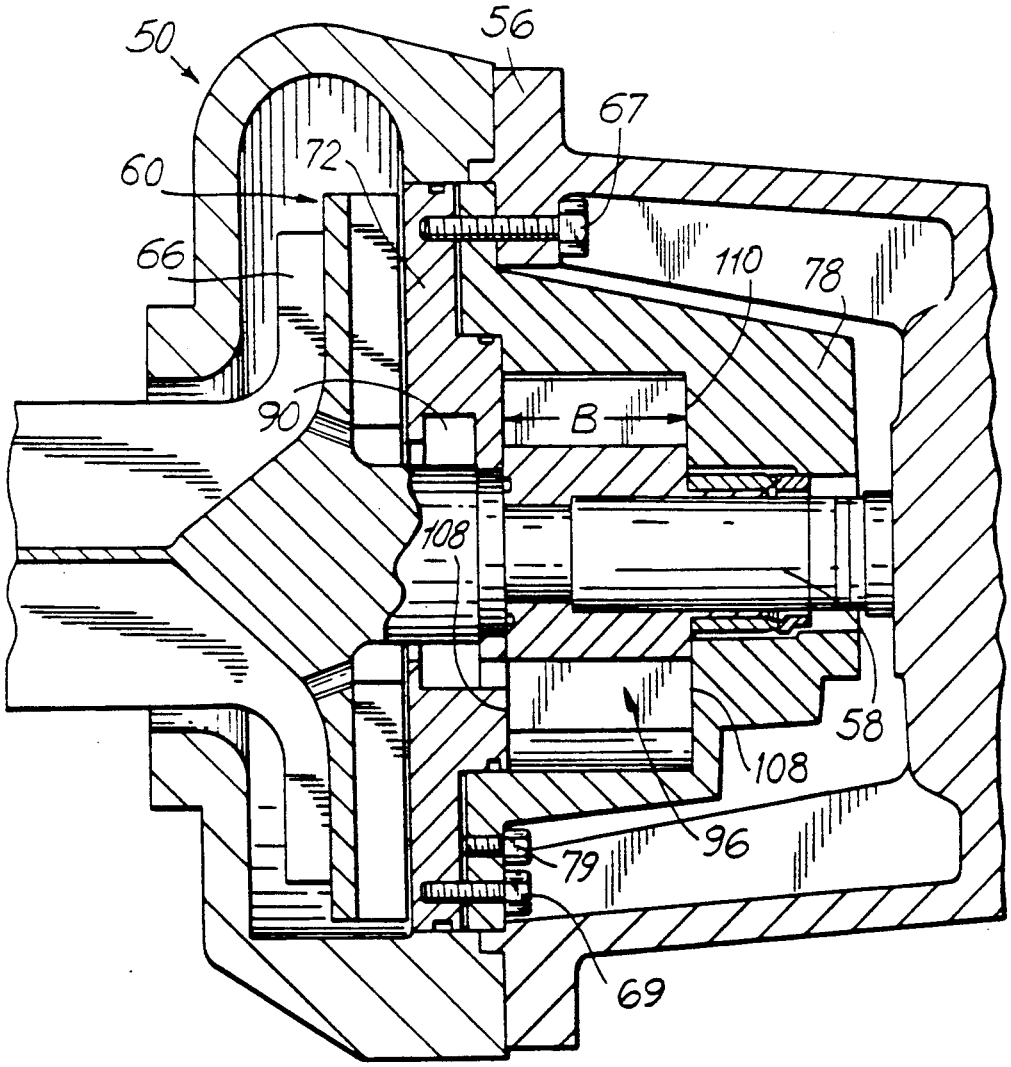
FIG. 7 is a partial cross-sectional view of yet another embodiment of the present invention.

Alternatively, and as shown in FIG. 7, the vacuum pump housing 78 and intermediate plate or head 72 can be adjusted relative to each other so that the width B and thereby the clearance 108 between the vacuum pump rotor and the vacuum pump side walls are optimized. The vacuum pump housing 78 and head 72 are mounted on a protrusion of frame 56 containing an opening for receiving one or more bolts 67 which threadedly engage with head 72. Width B between the vacuum pump housing rear wall 110 and head 72 can be adjusted by turning of one or more adjusting screws 69, 79 whereby screw 69 pulls head 72 toward vacuum pump housing 78; while turning of screw 79 move its head away therefrom. Frame 56 is secured to pump housing 50 in known manner.

Figure 8:
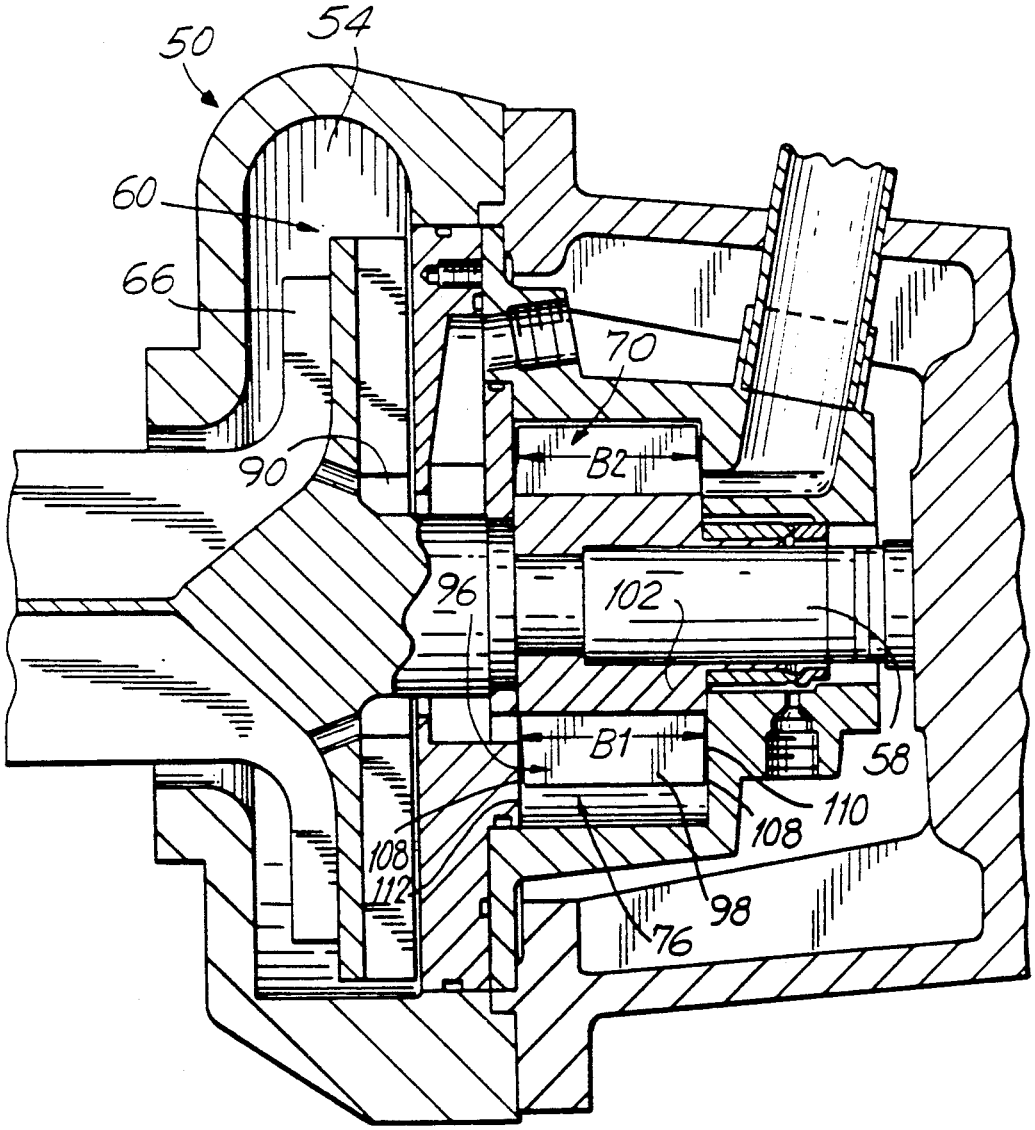
FIG. 8 is a partial cross-sectional view of yet another embodiment of the present invention.

FIG. 8 shows a vacuum pump rotor 96 which is arranged on pump shaft 58 at a distance from the bearing unit (not shown). In this case, the shaft 58 tends to bend slightly during operation of the pump and, consequently, the clearance 108 between the vacuum pump rotor vanes 98 and the end walls 110, 112 of the vacuum chamber 76 will change so that there is a real risk of mechanical contact between the vanes 98 and the end walls 110, 112 causing extensive wear or even serious damage to the vacuum pump 70 in relatively short time. As shown in FIG. 8, the axial length of the vanes 98 at the respective tips of the vanes is shorter than the axial length thereof at or close to the central portion 102 of the vacuum pump rotor 96. In other words, the clearance 108 decreases in the direction from the tips of the vanes 98 toward the shaft 58.

Figure 9:
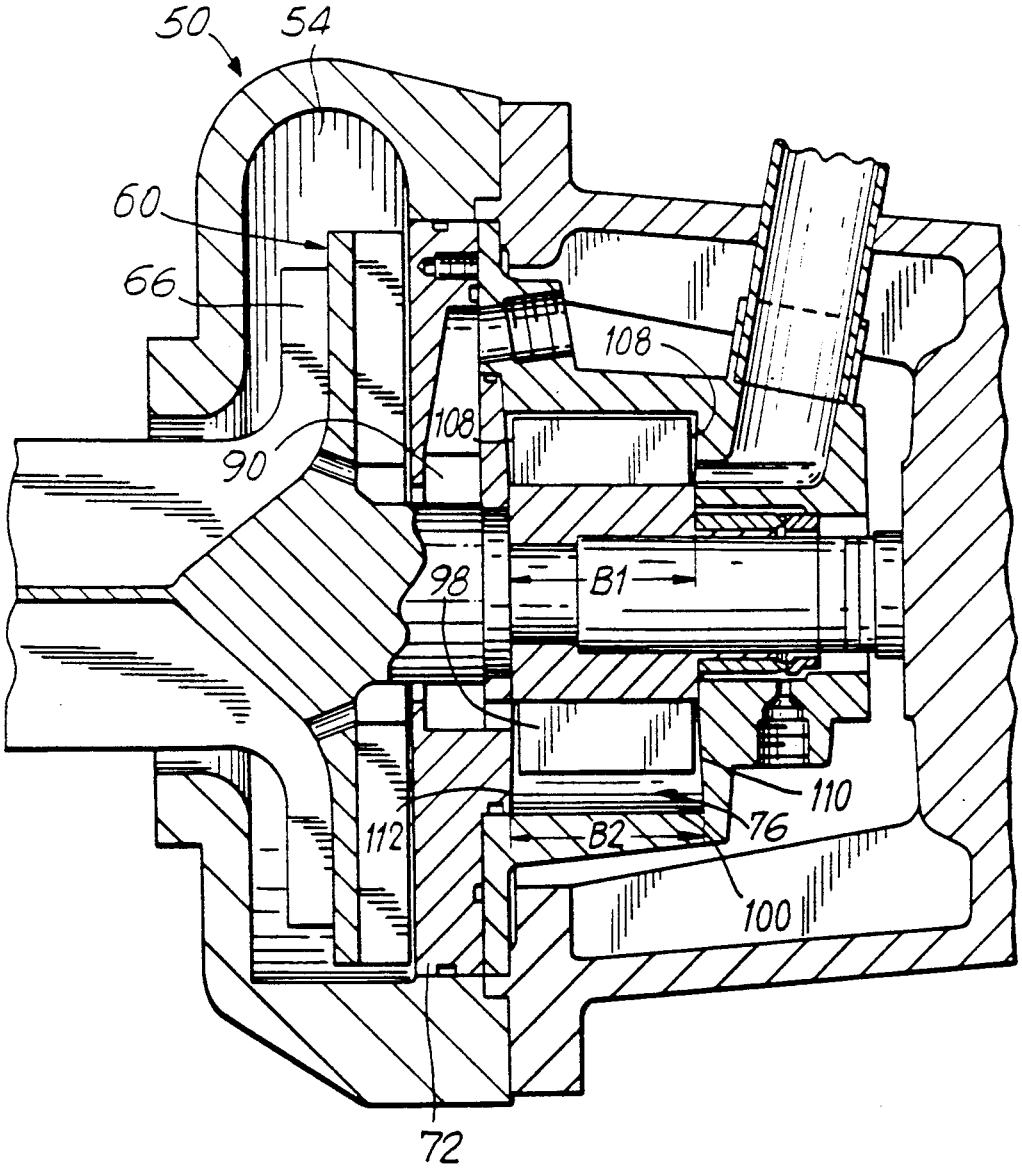
FIG. 9 is a vertical cross-sectional view of a further embodiment of the present invention.

FIG. 9 shows yet another embodiment and solution to the shaft bending problem. In this embodiment, vacuum pump vanes 98 have equal axial length however, the axial dimension of the eccentric vacuum pump chamber 76 increases towards the outer circumference or surface 100 of the chamber 76 so that the amount of clearance 108 increases in radial direction in the same way as in the embodiment shown in FIG. 8. Accordingly, the axial distance B1 of the vacuum pump chamber 76 is smaller in the area surrounding the shaft than the distance B2 between the vacuum pump chamber side walls at the eccentric surface 100. It is understood that the decrease in width of the vacuum pump rotor blades can be linear, stepped, curved or any combination thereof. Equally, the vacuum pump chamber side walls may be tapered radially outwardly in linear fashion, stepped, curved or in any combination thereof. It is also understood that both the vanes and the vacuum pump side walls may be tapered in radially outward direction in the same or similar manner.

It should be understood that the preferred embodiments and examples described are for illustrative purposes only and are not to be construed as limiting the scope of the present invention which is properly delineated only in the appended claims.

What is claimed is:

1. A centrifugal pump for pumping gas containing medium comprising:

a centrifugal pumping chamber (54);

a centrifugal impeller (60) within said pumping chamber;

a liquid ring vacuum pump (70) having a vaned vacuum pump rotor (96) therein;

an intermediate wall (72) separating said pumping chamber (54) from said vacuum pump (70) and having a first non-annular opening (74) adjacent said pumping chamber for providing a passageway between said centrifugal pumping chamber (54) and said vacuum pump; and a shaft (58) extending through said vacuum pump (70) and said intermediate wall (72) into said pumping chamber (54), said centrifugal impeller (60) and said vacuum pump rotor (96) being mounted on said shaft.

2. The centrifugal pump as claimed in claim 1, additionally comprising a second non-annular volume (146) within said intermediate wall (72) extending between said first non-annular opening (74) and said vacuum pump.

3. The centrifugal pump as claimed in claim 2, additionally comprising a conduit (71) within said intermediate wall (72) and connected to said second non-annular volume (146) for introducing a liquid into at least one of said second non-annular volume (146) and said vacuum pump (70).

4. The centrifugal pump as claimed in claim 2, wherein said vacuum pump (70) has a pressure side and a suction side and additionally comprising a gas inlet opening (94) at said suction side and communicating with said second non-annular volume (146); a rear wall (110) opposite said gas inlet opening (94); a gas discharge opening (80) at said pressure side; and a make-up air inlet duct (84) extending into said vacuum (70) through said rear wall (110).

5. The centrifugal pump as claimed in claim 2, additionally comprising a conduit (71) within said intermediate plate (72); a gas inlet port (94) in said intermediate wall connecting said vacuum pump (70) with said non-annular volume (146); and said conduit (71) being connected to said non-annular volume (146) for introducing a liquid into at least one of said gas inlet opening (94), non-annular volume (146) and said non-annular opening (74).

6. The centrifugal pump as claimed in claim 1, wherein said vacuum pump comprises a front wall (112) and a rear wall (110) opposite said front wall; said vacuum pump rotor (96) being mounted for rotation on said shaft between said front and said rear wall at a distance therefrom; and means for axially adjusting said distance between said vacuum pump rotor and at least one of said front wall and said rear wall.

7. The centrifugal pump as claimed in claim 6 wherein said distance between said vacuum pump rotor (96) and said respective front and rear walls (112, 110) of said pump 70 is less than 0.30 mm.

8. The centrifugal pump as claimed in claim 6, wherein said adjustment means for the axial adjustment comprises a first shoulder (104) on said shaft (58) and an oppositely extending second shoulder (105) on said rotor (96) facing said first shoulder (104) of said shaft and spacing means (106) between said shoulders for adjusting the position of said rotor (96) relative to said front and rear wall of said vacuum pump (70).

9. The centrifugal pump as claimed in claim 8, wherein said spacing means comprises one or more shims for placement between said first shoulder (104) and said second shoulder (105).

10. The centrifugal pump as claimed in claim 1, additionally comprising a rotor having fluidizing blades, said rotor mounted in front of said impeller.

* * * * *